US010173442B2

(12) United States Patent
Shiiya et al.

(10) Patent No.: US 10,173,442 B2
(45) Date of Patent: Jan. 8, 2019

(54) PRINTING METHOD

(71) Applicant: SEIKO EPSON CORPORATION, Tokyo (JP)

(72) Inventors: Tomoyuki Shiiya, Matsumoto (JP); Masashi Kitahara, Minamiminowa (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 15/919,021

(22) Filed: Mar. 12, 2018

(65) Prior Publication Data

US 2018/0272759 A1 Sep. 27, 2018

(30) Foreign Application Priority Data

Mar. 21, 2017 (JP) ..... 2017-054068

(51) Int. Cl.

| | |
|---|---|
| ***B41J 29/38*** | (2006.01) |
| ***B41J 11/00*** | (2006.01) |
| ***B65H 18/14*** | (2006.01) |
| ***B65H 20/02*** | (2006.01) |
| ***B41J 15/04*** | (2006.01) |

(52) U.S. Cl.

CPC ..... *B41J 11/0095* (2013.01); *B41J 15/046* (2013.01); *B65H 18/145* (2013.01); *B65H 20/02* (2013.01)

(58) Field of Classification Search

CPC ... B41J 11/0095; B41J 15/046; B65H 18/145; B65H 20/02

USPC ..... 347/5, 16, 101, 104

See application file for complete search history.

(56) References Cited

U.S. PATENT DOCUMENTS

| | | | | |
|---|---|---|---|---|
| 8,672,323 | B2 * | 3/2014 | Blanchard | B41F 13/02 198/689.1 |
| 9,850,086 | B2 * | 12/2017 | Smeyers | B65H 9/002 |
| 2012/0081447 | A1 * | 4/2012 | Nakano | B41J 11/46 347/16 |
| 2016/0272451 | A1 | 9/2016 | Yamashita et al. | |

FOREIGN PATENT DOCUMENTS

| | | |
|---|---|---|
| JP | 2016-175216 A | 10/2016 |

* cited by examiner

*Primary Examiner* — An Do

(74) *Attorney, Agent, or Firm* — Workman Nydegger

(57) ABSTRACT

A printing method of a printing apparatus which includes a transport unit, a transport position output unit, a mark detecting unit, a steering unit, and a storage unit, the method including first processing in which the medium is transported by a first distance in the second direction, and positions the first mark on the downstream side of the detecting region in the second direction; second processing in which arriving at a predetermined position of the first mark is detected based on the output value of the drum encoder and a reference value; and third processing in which printing is started based on a detecting timing of the first mark, in which the first distance is a first stable transport distance or more which converges a deviation amount in the third direction into a predetermined first deviation amount until the first mark reaches the first predetermined position.

6 Claims, 6 Drawing Sheets

PRINTING METHOD

BACKGROUND

1. Technical Field

The present invention relates to a printing method.

2. Related Art

In the related art, a printing apparatus which performs printing of a long recording medium using a roll-to-roll transporting method has been known. In such a printing apparatus, it is necessary to accurately perform positioning of a printing position between a stop and a restart of printing. In JP-A-2016-175216, a printing method in which a recording medium is temporarily transported in a backward direction after temporarily stopping printing, detects a printed mark on the recording medium which denotes a printing restart timing when performing transporting in the forward direction again, and restarts printing based on that, in a printing apparatus provided with a steering unit for correcting meandering of the recording medium (hereinafter, also referred to as steering correction) which occurs when transporting the recording medium in the forward direction.

However, in the printing method described in JP-A-2016-175216, there is a problem in that a detection failure of a mark occurs by the mark which is out of a detection region of a mark detecting unit (mark detecting sensor) due to meandering of the recording medium which occurs when the recording medium is transported in the backward direction in which the steering correction does not work, an advanced movement mechanism which moves a position of the mark detecting unit following meandering of the recording medium is necessary, in order to prevent the problem of causing deviation of a printing position when restarting printing, and a cost of a printing apparatus increases.

SUMMARY

The invention can be realized in the following aspects or application examples.

Application Example 1

According to this application example, there is provided a printing method of a printing apparatus which includes a transport unit which transports a recording medium in a first direction or a second direction opposite to the first direction; a transport position output unit which outputs a signal which is used when obtaining a transport position of the recording medium using the transport unit; a printing unit which prints an image on the recording medium; a mark detecting unit which detects a mark overlapped with a detecting region among a plurality of the marks which are provided in the recording medium in parallel to the first direction; a steering unit which corrects a movement of the recording medium in a third direction which intersects the first direction, when transporting the recording medium in the first direction; and a storage unit which stores an output value output from the transport position output unit when a first mark among the plurality of marks corresponding to a position at which printing of the image is started, is located at a first predetermined position with respect to the detecting region as a reference value, the method including first processing in which the recording medium is transported by a first distance in the second direction based on an output value of the transport position output unit, and the first mark is positioned on a downstream side of the detecting region in the second direction; second processing in which a transport of the recording medium in the first direction is started after the first processing, and arriving at the first predetermined position of the first mark is detected based on a comparison of the output value of the transport position output unit and the reference value; and third processing in which printing of the image using the printing unit is started based on a timing in which the first mark which moves from the first predetermined position to the detecting region is detected by the mark detecting unit, after the second processing, in which the first distance is a first stable transport distance or more which is necessary when converging a deviation amount of the recording medium in the third direction into a predetermined first deviation amount by a correction using the steering unit until the first mark reaches the detecting region in the second processing.

According to the application example, the printing method includes the first processing in which the recording medium is transported in the second direction by the first distance based on the output value of the transport position output unit, the second processing in which the recording medium is transported in the first direction, and arriving at the first predetermined position of the first mark is detected based on a comparison of the output value of the transport position output unit and a reference value as an output value which is output from the transport position output unit when the first mark corresponding to a position at which printing of an image is restarted is located at the first predetermined position with respect to the detecting region of the mark detecting unit; and third processing in which printing of the image is started based on a timing in which the first mark which moves from the first predetermined position to the detecting region is detected by the mark detecting unit. The first distance is the first stable transport distance or more which is necessary when converging the deviation amount of the recording medium in the third direction into the predetermined first deviation amount using a correction by the steering unit.

Transporting of the recording medium in the second direction in the first processing, and transporting of the recording medium to the predetermined position in the first direction in the second processing are performed based on the output value of the transport position output unit. A transport error occurs in transporting of the recording medium based on the transport position output unit, due to sliding, or the like, which occurs between the transport unit and the recording medium; however, since starting of printing is performed based on a timing in which the mark detecting unit detects the first mark in the third processing, it is possible to settle a printing position between an interruption and a restart of printing with good accuracy.

Since the first distance in which the recording medium is transported in the second direction in the first processing is the first stable transport distance or more, a deviation of the first mark (recording medium) in the third direction which occurs when being transported in the second direction is corrected by the steering unit so as to fall within the predetermined first deviation amount when being transported in the first direction using the second processing. In this manner, it is possible to catch the first mark in the detecting region of the mark detecting unit even in a printing apparatus which is not provided with the advanced movement mechanism which moves a position of the mark detecting unit following meandering of the recording medium. Accordingly, it is possible to provide a printing method in which an accuracy of a printing position between an interruption and a restart of printing is easily improved without accompanying a rise in cost of the printing apparatus.

Application Example 2

In the printing method according to the application example, it is preferable to include processing of obtaining the reference value before the first processing.

According to the application example, the printing method includes the processing of obtaining the output value output from the transport position output unit as the reference value when the first mark is located at the first predetermined position before the first processing. In this manner, since a timing in which the first mark reliably reaches the first predetermined position can be obtained as the reference value, it is possible to improve an accuracy of obtaining a predetermined position in which an accuracy of a printing start position when restarting printing is improved.

Application Example 3

In the printing method according to the application example, it is preferable that the processing of obtaining the reference value include fourth processing in which the recording medium is transported in the second direction based on the output value of the transport position output unit, and the first mark is positioned on a downstream side of the detecting region in the second direction by a second distance; fifth processing in which the first mark is positioned in the detecting region by transporting the recording medium, after the fourth processing; and sixth processing in which the first mark is positioned at the first predetermined position by transporting the recording medium after the fifth processing, and the output value output from the transport position output unit is stored in the storage unit as the reference value, when the first mark reaches the first predetermined position.

According to the application example, the processing of obtaining the reference value includes the fourth processing in which the first mark is positioned on the downstream side of the detecting region in the second direction by the second distance, the fifth processing in which the first mark is positioned in the detecting region, and the sixth processing in which the first mark is positioned at the first predetermined position, and the output value output from the transport position output unit is stored in the storage unit as the reference value when the first mark reaches the first predetermined position. A deviation of the recording medium in the third direction which occurs when the recording medium is moved in the second direction in the fourth processing, in order to detect the first mark in the fifth processing is corrected by the steering unit in transporting (stable transport) of the recording medium in the first direction from the fourth processing to the fifth processing. In this manner, it is possible to improve a detecting accuracy of the first mark for obtaining a reference value in the sixth processing.

Application Example 4

In the printing method according to the application example, it is preferable that the fifth processing include seventh processing in which the recording medium is transported in the first direction based on the output value from the transport position output unit, and the first mark is positioned at a second predetermined position which is the downstream side of the detecting region in the first direction by a third distance; and eighth processing in which the recording medium is transported in the second direction based on the output value of the transport position output unit, and the first mark located at the second predetermined position is positioned in the detecting region.

According to the application example, the fifth processing includes the seventh processing in which the first mark is positioned at the second predetermined position which is the downstream side of the detecting region in the first direction by the third distance, and the eighth processing in which the first mark located at the second predetermined position is positioned in the detecting region. In the seventh processing, since the first mark is positioned at the second predetermined position on the downstream side of the detecting unit in the first direction once, a mark which is firstly detected by transporting in the second direction in the eighth processing reliably becomes the first mark.

Application Example 5

In the printing method according to the application example, it is preferable that the second distance be a second stable transport distance or more which is necessary when converging a deviation amount of the recording medium in the third direction into a predetermined second deviation amount, by a correction using the steering unit, until the first mark reaches the detecting region in the seventh processing.

According to the application example, in the printing method, a stable transport which is the second stable transport distance or more which is necessary when converging the deviation amount of the recording medium in the third direction into the predetermined second deviation amount by a correction using the steering unit is performed, in the seventh processing before the eighth processing in which the first mark is positioned in the detecting region. In this manner, it is possible to reliably position the first mark in the detecting region.

Application Example 6

In the printing method according to the application example, it is preferable that the first deviation amount be smaller than the second deviation amount, and the second stable transport distance be shorter than the first stable transport distance.

According to the application example, since the second stable transport distance is shorter than the first stable transport distance, it is possible to shorten a time necessary in processing for obtaining the reference value.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of the invention will be described with reference to drawings.

Embodiment

Schematic Configuration of Printing Apparatus

Figure 1:
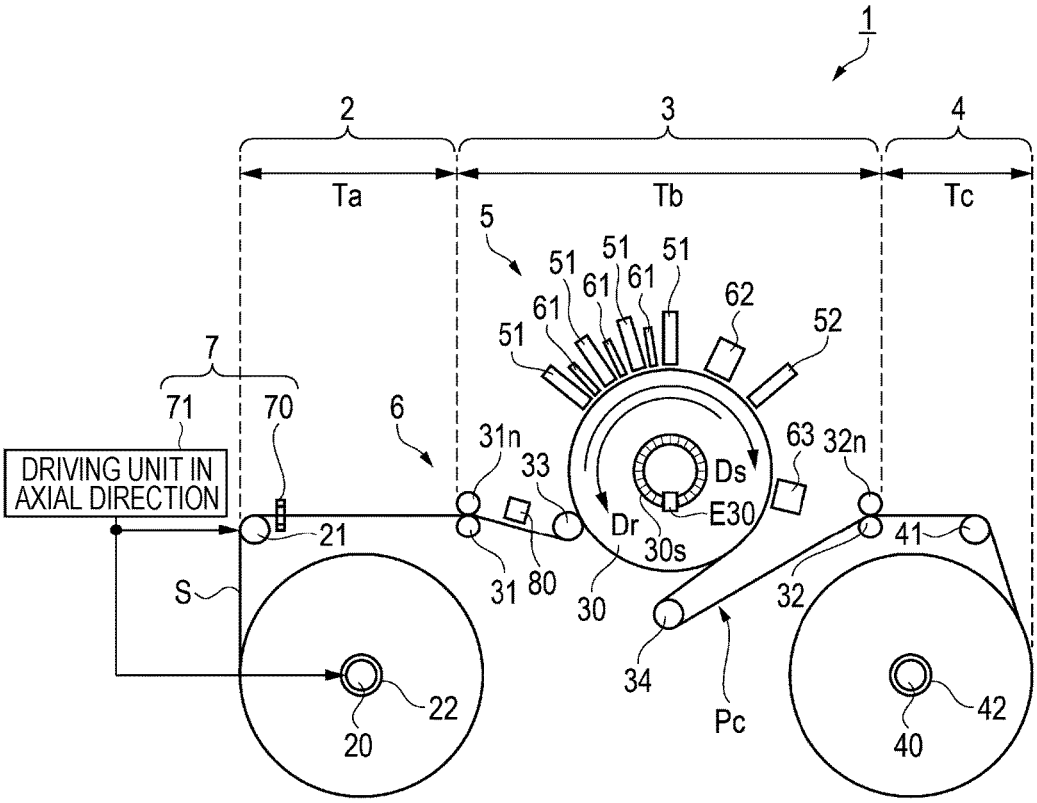
FIG. 1 is a schematic view which illustrates approximately the entire configuration of a printing apparatus according to an embodiment.

FIG. 1 is a schematic view which illustrates approximately the entire configuration of a printing apparatus according to the embodiment. First, a schematic configuration of a printing apparatus 1 according to the embodiment will be described with reference to FIG. 1. According to the embodiment, the printing apparatus 1 which is provided with a rotating drum 30 which supports a recording medium S in a cylindrical shape, and transports the recording medium S using a roll-to-roll method will be described as an example.

As illustrated in FIG. 1, the printing apparatus 1 is provided with a transport unit 6 which transports the recording medium S in a forward direction Ds as a first direction or a backward direction Dr as a second direction opposite to the first direction, and a printing unit 5 which prints an image on the recording medium S. The transport unit 6 includes a sending shaft 20 which sends out the recording medium S, a front driving roller 31 and a rear driving roller 32 which transport the recording medium S, a rotating drum 30 as a medium support unit which supports the recording medium S in a cylindrical shape, and a winding shaft 40 which winds up the recording medium S. In the embodiment, the sending shaft 20 side becomes an upstream side in a transport direction, and the winding shaft 40 side becomes a downstream side in the transport direction when transporting the recording medium S in the forward direction Ds. In addition, the winding shaft 40 side becomes the upstream side in the transport direction, and the sending shaft 20 side becomes the downstream side in the transport direction when transporting the recording medium S in the backward direction Dr. In addition, in the embodiment, when the transport direction of the recording medium S is referred to as the upstream side without designating the transport direction, the sending shaft 20 side is the upstream side, and when being referred to as the downstream side without designating the transport direction of the recording medium S, the winding shaft 40 side is the downstream side.

In the printing apparatus 1, a long recording medium S of which both ends are wound around the sending shaft 20 and the winding shaft 40 in a roll shape is stretched along a transport path Pc. The recording medium S receives recording of an image in the printing unit 5 while being transported in the forward direction Ds in the rotating drum 30 which is provided at a portion between the sending shaft 20 and the winding shaft 40. A type of the recording medium S is roughly classified into paper and a film. Specifically, there are fine paper, cast paper, art paper, coated paper, and the like, in the paper, and there are synthetic paper, polyethylene terephthalate (PET), polypropylene (PP), and the like, in the film. The printing apparatus 1 is schematically configured of three regions of a sending region 2 in which the recording medium S is send out from the sending shaft 20, a processing region 3 in which an image is recorded on the recording medium S which is sent out from the sending region 2, and a winding region 4 in which the recording medium S on which the image is recorded in the processing region 3 is wound around the winding shaft 40. In the following descriptions, a face on which the image is recorded is referred to as the front surface, and a face on a side opposite thereto is referred to as the rear face, in both faces of the recording medium S.

The sending shaft 20 around which one end of the recording medium S is wound, and a driven roller 21 which winds up the recording medium S pulled out from the sending shaft 20 are included in the sending region 2. The sending shaft 20 supports the recording medium S by winding one end thereof in a state in which the front surface of the recording medium S faces the outer side. In addition, when the sending shaft 20 rotates in clockwise in FIG. 1, the recording medium S wound around the sending shaft 20 is sent out to the processing region 3 via the driven roller 21. The driven roller 21 is a roller which rotates in a driven manner in the forward direction Ds or the backward direction Dr of the recording medium S by being in contact with the recording medium S, and receiving a frictional force between the roller and the transported recording medium S. Incidentally, the recording medium S is wound around the sending shaft 20 through a core tube 22 which can be detached from the sending shaft 20. Accordingly, when the recording medium S of the sending shaft 20 is used up, it is possible to exchange the recording medium S of the sending shaft 20, by mounting a new core tube 22 around with the roll-shaped recording medium S is wound on the sending shaft 20.

The printing apparatus 1 is provided with a steering unit 7 which corrects a movement of the recording medium S in an axial direction Da (direction perpendicular to paper face in FIG. 1) as a third direction which intersects the first direction of the recording medium S when transporting the recording medium S in the first direction (forward direction Ds). Specifically, the sending shaft 20 and the driven roller 21 can move in the axial direction Da which is orthogonal to the forward direction Ds, and the steering unit 7 which suppresses meandering of the recording medium S by adjusting positions of the sending shaft 20 and the driven roller 21 to the axial direction Da (width direction of recording medium S) is provided in the sending region 2. The steering unit 7 is configured of an edge sensor 70 and a driving unit in axial direction 71.

The edge sensor 70 is provided at an end portion of the recording medium S in the axial direction Da on the downstream side of the driven roller 21 in the forward direction Ds, and detects a position of an end of the recording medium S in the axial direction Da. The edge sensor 70 includes a transmitter (not illustrated) which transmits an ultrasonic wave, and a receiver (not illustrated) which receives an ultrasonic wave. The transmitter and the receiver are disposed by interposing the recording medium S therebetween. The transmitter transmits an ultrasonic wave to a circular detecting region with a width of approximately 10 mm in the axial direction Da. The receiver receives the ultrasonic wave which passed through the detecting region.

The driving unit in axial direction 71 suppressed meandering of the recording medium S by adjusting positions of the sending shaft 20 and the driven roller 21 in the axial direction Da based on a detecting result of the edge sensor 70.

In the processing region 3, the recording medium S which is sent out from the sending region 2 is supported by the rotating drum 30, processing with respect to the recording medium S is appropriately performed by the printing unit 5 which is configured of recording heads 51 and 52, and UV irradiators 61, 62, and 63 which are disposed along the outer peripheral face of the rotating drum 30, and an image is recorded on the recording medium S. The front driving roller 31 as a driving roller which transports the recording medium S toward the rotating drum 30 is provided on the upstream side of the processing region 3, and a rear driving roller 32 which transports the recording medium S toward the winding shaft 40 is provided on the downstream side of the processing region 3. The recording medium S transported from the front driving roller 31 to the rear driving roller 32 is supported by the rotating drum 30.

The front driving roller 31 includes a plurality of fine protrusions which are formed using spraying on the outer peripheral face, and winds up the recording medium S which is sent out from the sending region 2 from the rear face side. In addition, when the front driving roller 31 rotates in clockwise in FIG. 1, the recording medium S which is sent out from the sending region 2 is transported to the downstream side of the transport path Pc. A nip roller 31*n* is provided by facing the front driving roller 31. The nip roller 31*n* comes into contact with the front surface of the recording medium S in a state of being urged to the front driving roller 31 side, and interposes the recording medium S between the roller and the front driving roller 31. In this manner, a frictional force between the front driving roller 31 and the recording medium S is secured, and it is possible to reliably perform transporting of the recording medium S using the front driving roller 31.

The rotating drum 30 is a cylindrical drum with a diameter of, for example, 400 mm, which is supported by a support mechanism (not illustrated), and winds up the recording medium S which is transported from the front driving roller 31 to the rear driving roller 32 from the rear face side. The rotating drum 30 rotates in a driven manner in the forward direction Ds of the recording medium S by receiving a frictional force between the drum and the recording medium S which is transported, while supporting the recording medium S from the rear face side. Incidentally, in the processing region 3, driven rollers 33 and 34 which change a travelling direction of the recording medium S on both sides in the forward direction Ds in a region in which the recording medium S is wound around the rotating drum 30 are provided. In these, the driven roller 33 turns back the travelling direction of the recording medium S toward the rotating drum 30 by winding up the front surface of the recording medium S between the front driving roller 31 and the rotating drum 30 in the forward direction Ds. Meanwhile, the driven roller 34 turns back the travelling direction of the recording medium S by winding up the front surface of the recording medium S between the rotating drum 30 and the rear driving roller 32 in the forward direction Ds. In this manner, it is possible to secure a long wound portion of the recording medium S around the rotating drum 30 by turning back the recording medium S on the upstream side and the downstream side in the forward direction Ds, respectively, with respect to the rotating drum 30.

A drum encoder E30 as a transport position output unit which outputs a signal which can be used when obtaining a transport position of the recording medium S using the transport unit 6 is provided in the rotating drum 30. Specifically, a disk-shaped rotary scale 30*s* is provided in the rotating shaft of the rotating drum 30. A magnetic scale in which magnets with different polarities are alternately disposed along a circumferential direction is used in the rotary scale 30*s* in the embodiment. The drum encoder E30 is provided at a position facing the rotary scale 30*s*. The drum encoder E30 is provided with an element which converts a change in a magnetic field into an electrical signal (for example, Hall element, MR element, or the like), and detects a relative movement amount with respect to the rotary scale 30*s*. That is, it is possible to obtain a transport position of the recording medium S (transport distance) from a signal denoting a rotating amount (displacement of angle) of the rotating drum 30 which is output from the drum encoder E30.

In the embodiment, a configuration in which a transport position of the recording medium S is obtained by the transport position output unit (drum encoder E30) which detects a rotation amount of the rotating drum 30 is exemplified; however, it may be a configuration in which a transport position of the recording medium S is obtained by a transport position output unit which detects a rotation amount of the front driving roller 31 or the rear driving roller 32.

In addition, according to the embodiment, a so-called magnetic encoder in which a relative movement amount of the rotary scale 30*s* and the drum encoder E30 is obtained, using a change in magnetic field is exemplified; however, it may be an optical encoder which obtains a movement amount using an optical change.

The rear driving roller 32 has the plurality of fine protrusions which are formed using spraying, on the circumferential face, and winds up the recording medium S transported from the rotating drum 30 through the driven roller 34 from the rear face side. In addition, when the rear driving roller 32 rotates in clockwise in FIG. 1, the recording medium S is transported to the winding region 4. A nip roller 32*n* is provided by facing the rear driving roller 32. The nip roller 32*n* comes into contact with the front surface of the recording medium S in a state of being urged to the rear driving roller 32 side, and interposes the recording medium S between the nip roller and the rear driving roller 32. In this manner, a frictional force between the rear driving roller 32 and the recording medium S is secured, and it is possible to reliably perform transporting of the recording medium S using the rear driving roller 32.

In this manner, the recording medium S transported from the front driving roller 31 to the rear driving roller 32 is supported on the outer peripheral face of the rotating drum 30. In addition, a plurality of recording heads 51 corresponding to colors different from each other are provided in the printing unit 5, in order to record a color image on the front surface of the recording medium S which is supported by the rotating drum 30. According to the embodiment, four recording heads 51 corresponding to a yellow color, a cyan color, a magenta color, and a black color are aligned in the forward direction Ds in this order. Each of the recording heads 51 faces the front surface of the recording medium S which is wound around the rotating drum 30 with a slight interval, and ejects ink (color ink) of a corresponding color from a nozzle in the recording head using an ink jet method. In addition, a color image is formed on the front surface of the recording medium S, when each recording head 51 ejects ink onto the recording medium S which is transported in the forward direction Ds.

Incidentally, as ink, ultraviolet (UV) ink (photocurable ink) which is cured by being irradiated with an ultraviolet ray (light) is used. Therefore, the UV irradiators 61 and 62 are provided in the processing region 3, in order to fix ink on the recording medium S by curing thereof. In addition, curing of ink is performed by being divided into two stages of temporary curing and main curing. The UV irradiators 61 for temporary curing are disposed between the plurality of recording heads 51, respectively. That is, the UV irradiator 61 cures ink to an extent in which wet-spreading of the ink is sufficiently late (temporary curing), compared to a case of irradiating UV light, by irradiating UV light with low irradiating intensity, and does not perform main curing of the ink. Meanwhile, the UV irradiator 62 for main curing is provided on the downstream side of the plurality of recording heads 51 in the forward direction Ds. That is, the UV irradiator 62 cures (main curing) ink to an extent in which wet-spreading of the ink stops, by irradiating UV light with high irradiating intensity compared to the UV irradiator 61.

In this manner, the UV irradiators 61 which are respectively disposed between the plurality of recording heads 51 temporarily cure color ink which is ejected onto the recording medium S from the recording head 51 on the upstream side in the forward direction Ds. Accordingly, the ink ejected onto the recording medium S from the recording head 51 on the upstream side in the two recording heads 51 which are adjacent to each other is temporarily cured while reaching the recording head 51 on the downstream side, along with transporting of the recording medium S. Due to this, it is possible to prevent an occurrence of mixing of colors in which color ink of different colors are mixed. The plurality of recording heads 51 eject color ink different from each other in such a state in which mixing of colors is suppressed, and form a color image on the recording medium S. In addition, the UV irradiator 62 for main curing is provided on the downstream side of the plurality of recording heads 51 in the forward direction Ds. For this reason, the color image formed by the plurality of recording heads 51 is fixed to the recording medium S by being subjected to main curing by the UV irradiator 62.

The recording head 52 is provided on the downstream side of the UV irradiator 62 in the forward direction Ds. The recording head 52 faces the front surface of the recording medium S which is wound around the rotating drum 30 with a slight interval, and ejects transparent UV ink onto the front surface of the recording medium S from a nozzle using an ink jet method. That is, the transparent ink is further ejected to the color image formed by the recording heads 51 of four colors. The transparent ink is ejected to the entire face of the color image, and gives a texture such as glossiness or a feeling of mat to the color image. In addition, the UV irradiator 63 is provided on the downstream side of the recording head 52 in the forward direction Ds. The UV irradiator 63 performs main curing of the transparent ink ejected from the recording head 52, by irradiating UV light with higher irradiating intensity than that of the UV irradiator 61. In this manner, it is possible to fix the transparent ink onto the front surface of the recording medium S.

In this manner, in the processing region 3, ejecting and curing of ink are appropriately performed with respect to the recording medium S which is wound around the rotating drum 30 at the outer peripheral portion, and a color image applied with a texture using transparent ink is formed. In addition, the recording medium S on which the color image is formed is transported to the winding region 4 using the rear driving roller 32.

In the processing region 3, a mark detecting unit 80 which detects a mark which is overlapped with a detecting region 85 (refer to FIG. 10) among a plurality of marks MK (refer to FIG. 10) provided on the recording medium S in parallel in the first direction (forward direction Ds), which will be described later, is provided. The mark detecting unit 80 is disposed between the front driving roller 31 and the rear driving roller 33. The plurality of marks MK are printed along with an image in order to obtain a timing for restarting printing which is temporarily stopped, and the mark detecting unit 80 detects a mark MK on the recording medium S which is transported for restarting of printing. Here, the plurality of marks MK are not limited to be printed along with an image, and may be provided on the recording medium S in advance.

The mark detecting unit 80 is a reflective photo sensor provided with a light output unit (not illustrated) which outputs light, and a light receiving unit (not illustrated) which receives light. The light output unit is configured of, for example, a light emitting diode, a tungsten lamp, or the like, and a region which is spot-irradiated on the recording medium S becomes a detecting region which detects a mark. The light receiving unit is, for example, configured of an optical sensor such as a photodiode, receives light which is output, and is reflected on the recording medium S, and outputs a voltage value corresponding to a light receiving amount thereof. In this manner, it is possible to detect a mark which reaches the detecting region. In addition, the mark detecting unit 80 includes a movement mechanism (not illustrated), and is configured so as to move in the axial direction Da which intersects the forward direction Ds.

The winding region 4 includes a driven roller 41 which winds up the recording medium S at a portion between the winding shaft 40 and the rear driving roller 32 from the rear face side, in addition to the winding shaft 40 around which the other end of the recording medium S is wound. The winding shaft 40 supports the other end of the recording medium S by winding thereof in a state in which the front surface of the recording medium S faces the outer side. That is, when the winding shaft 40 rotates in clockwise in FIG. 1, the recording medium S transported from the rear driving roller 32 is wound around the winding shaft 40 through the driven roller 41. Incidentally, the recording medium S is wound around the winding shaft 40 through the core tube 42 which can be detachable from the winding shaft 40. Accordingly, when the recording medium S wound around the winding shaft 40 is full, it is possible to detach the recording medium S in each core tube 42.

Figure 2:
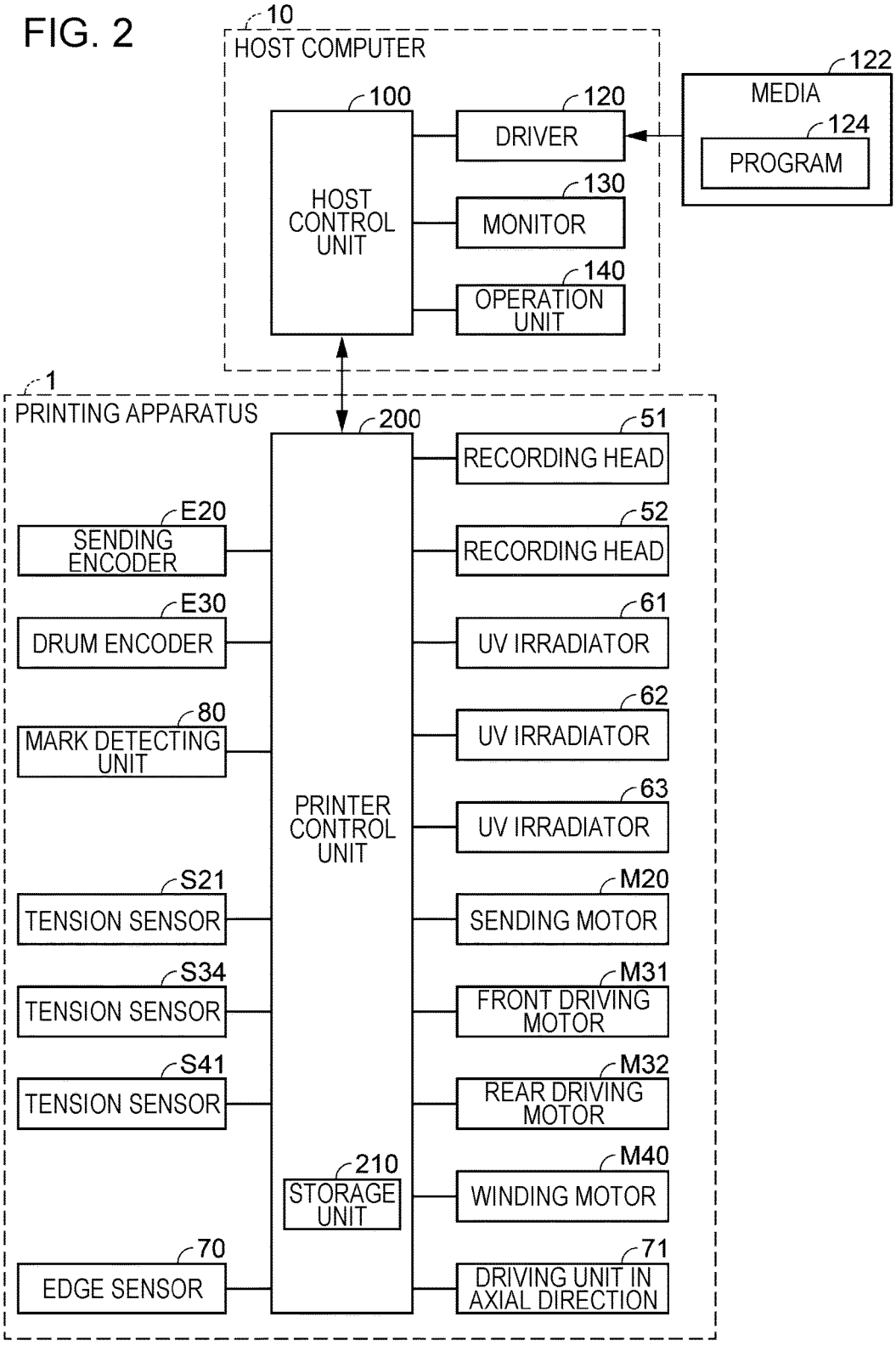
FIG. 2 is a block diagram which schematically illustrates an electrical configuration for controlling the printing apparatus.

Subsequently, an electrical configuration of controlling the printing apparatus 1 will be described. FIG. 2 is a block diagram which schematically illustrates the electrical configuration for controlling the printing apparatus. An operation of the above described printing apparatus 1 is controlled by the host computer 10 illustrated in FIG. 2. The host computer 10 may be provided in the printing apparatus 1, or may be provided out of the printing apparatus 1, separately from the printing apparatus 1. In the host computer 10, a host control unit 100 which integrates a control operation is configured of a central processing unit (CPU) or a memory. In addition, the host computer 10 includes a driver 120, and the driver 120 reads a program 124 from media 122. As the media 122, it is possible to use various media such as a compact disk (CD), a digital versatile disk (DVD), and a Universal Serial Bus (USB). In addition, the host computer 100 controls each unit of the host computer 10 or an operation of printing apparatus 1, based on the program 124 which is read from the media 122.

In addition, a monitor 130 which is configured of a liquid crystal display, or the like, and an operation unit 140 configured of a keyboard, a mouse, or the like, are provided in the host computer 10 as an interface with an operator. A menu screen is displayed on the monitor 130, in addition to an image as a printing target. Accordingly, the operator can set various printing conditions such as a type of a recording medium, a size of the recording medium, and a printing quality by opening a printing setting screen from a menu screen by operating the operation unit 140 while checking the monitor 130. A specific configuration of the interface with the operator can be variously changed, and for example, the operation unit 140 may be configured using a touch panel of the monitor 130 by using a touch panel display as the monitor 130.

Meanwhile, the printing apparatus 1 is provided with a printer control unit 200 as a control unit which controls each unit of the printing apparatus 1 according to an instruction from the host computer 10. In addition, the recording heads 51 and 52, the UV irradiators 61, 62, and 63, and each unit of the transport unit 6 are controlled by the printer control unit 200. A detailed control of the printer control unit 200 with respect to the each unit is as follows.

The printer control unit 200 is configured of a CPU (not illustrated) for performing processing of input signals from various detectors, or the like, or a control of the printing apparatus 1, a storage unit 210 for securing a region for storing a program of the CPU or a work region, or the like.

The printer control unit 200 controls an ink ejecting timing of each recording head 51 which forms a color image according to transporting of the recording medium S. Specifically, a control of the ink ejecting timing is executed based on an output (detected value) of the above described drum encoder E30. That is, since the rotating drum 30 rotates in a driven manner along with transporting of the recording medium S, it is possible to grasp a transport position of the recording medium S from an output value (rotation position, rotation amount) of the drum encoder E30. Therefore, the printer control unit 200 generates a print timing signal (pts) from an output of the drum encoder E30, causes ink ejected from each recording head 51 to landed on a target position of the recording medium S which is transported, by controlling an ink ejecting timing of each of recording heads 51 based on the Pts signal, and forms a color image.

Also a timing of ejecting the transparent ink by the recording head 52 is controlled by the printer control unit 200 based on an output of the drum encoder E30, similarly. In this manner, it is possible to exactly eject transport ink to a color image which is formed by the plurality of recording heads 51. In addition, also a timing of ON and OFF, or irradiation light intensity of the UV irradiators 61, 62, and 63 is controlled by the printer control unit 200.

The printer control unit 200 takes charge of function of controlling transporting of the recording medium S which is described using FIG. 1. That is, in each of units which configures the transport unit 6, motors are connected to the sending shaft 20, the front driving roller 31, the rear driving roller 32, and the winding shaft 40, respectively. In addition, the printer control unit 200 controls transporting of the recording medium S by controlling a speed or a torque of each motor while rotating these motors. A detail of transporting control of the recording medium S is as follows.

The printer control unit 200 supplies the recording medium S from the sending shaft 20 to the front driving roller 31 by rotating a sending motor M20 as a driving unit which drives the sending shaft 20. At this time, the printer control unit 200 adjusts a tension of the recording medium S (sending tension Ta) from the sending shaft 20 to the front driving roller 31 by controlling a driving force (torque) of the sending motor M20. That is, a tension sensor S21 as a detecting unit which detects the sending tension Ta is attached to the driven roller 21 which is disposed between the sending shaft 20 and the front driving roller 31 in the forward direction Ds. The tension sensor S21 can be configured of, for example, a load cell which detects a force received from the recording medium S. In addition, the printer control unit 200 adjusts the sending tension Ta of the recording medium S by performing a feedback control of the torque of the sending motor M20, based on a detection result of the tension sensor S21. In addition, the printer control unit 200 also controls the number of rotations of the sending shaft 20 based on an output (detected value) of a sending encoder E20 which detects the number of rotations of the sending shaft 20, by being attached to the sending shaft 20 when starting printing. The control of the number of rotations of the sending shaft 20 may be controlled based on an output of an encoder built in the sending motor M20, instead of the sending encoder E20.

The printer control unit 200 rotates a front driving motor M31 which drives the front driving roller 31, and a rear driving motor M32 which drives the rear driving roller 32. Due to this, the recording medium S which is sent out from the sending region 2 passes through the processing region 3. At this time, a speed control is performed with respect to the front driving motor M31, and meanwhile, a torque control is performed with respect to the rear driving motor M32. That is, the printer control unit 200 adjusts a rotation speed of the front driving motor M31 so as to be constant based on an encoder output of the front driving motor M31. In this manner, the recording medium S is transported at a constant speed by the front driving roller 31.

Meanwhile, the printer control unit 200 adjusts a tension of the recording medium S (processing tension Tb) from the front driving roller 31 to the rear driving roller 32 by controlling a torque of the rear driving motor M32. That is, a tension sensor S34 which detects the processing tension Tb is attached to the driven roller 34 which is disposed between the rotating drum 30 and the rear driving roller 32 in the forward direction Ds. The tension sensor S34 can be configured of a load cell which detects a force received from the recording medium S, for example. In addition, the printer control unit 200 adjusts the processing tension Tb of the recording medium S by performing a feedback control of the torque of the rear driving motor M32 based on a detection result of the tension sensor S34.

The printer control unit 200 winds the recording medium S transported by the rear driving roller 32 around the winding shaft 40 by rotating a winding motor M40 which drives the winding shaft 40. At this time, the printer control unit 200 adjusts a tension of the recording medium S (winding tension Tc) from the rear driving roller 32 to the winding shaft 40 by controlling a torque of the winding motor M40. That is, a tension sensor S41 which detects the winding tension Tc is attached to the driven roller 41 which is disposed between the rear driving roller 32 and the winding shaft 40 in the forward direction Ds. The tension sensor S41 can be configured of a load cell which detects a force received from the recording medium S, for example. In addition, the printer control unit 200 adjusts the winding tension Tc of the recording medium S by performing a feedback control of the torque of the winding motor M40 based on a detection result of the tension sensor S41.

In addition, the printer control unit 200 takes charge of a control function in the above described steering unit 7 which is provided in the sending region 2, and adjusts a position of an end of the recording medium S to a target position in the axial direction Da by performing a feedback control of the driving unit in axial direction 71 based on a detection result of the edge sensor 70. In addition, the target position is set so that positions of center lines of the front driving roller 31 and the rear driving roller 32 in the axial direction Da match a center line of the recording medium S. Accordingly, the recording medium S is transported in the forward direction Ds so that the center line of the recording medium S passes through the center lines of the front driving roller 31 and the rear driving roller 32. In this manner, since a load received by the recording medium S from a nip formed by the front driving roller 31 and the rear driving roller 32 becomes uniform in the axial direction Da, it is possible to transport the recording medium S in the forward direction Ds, while preventing the recording medium S from being biased in the axial direction Da.

The above description is an outline of an electrical configuration for controlling the printing apparatus 1.

Printing Method

In the printing apparatus 1 with the roll-to-roll method, there is a case in which printing is stopped due to maintenance, or the like, of the apparatus. Subsequently, a printing method when restarting printing after stopping printing of the printing apparatus 1 will be described.

Figure 3:
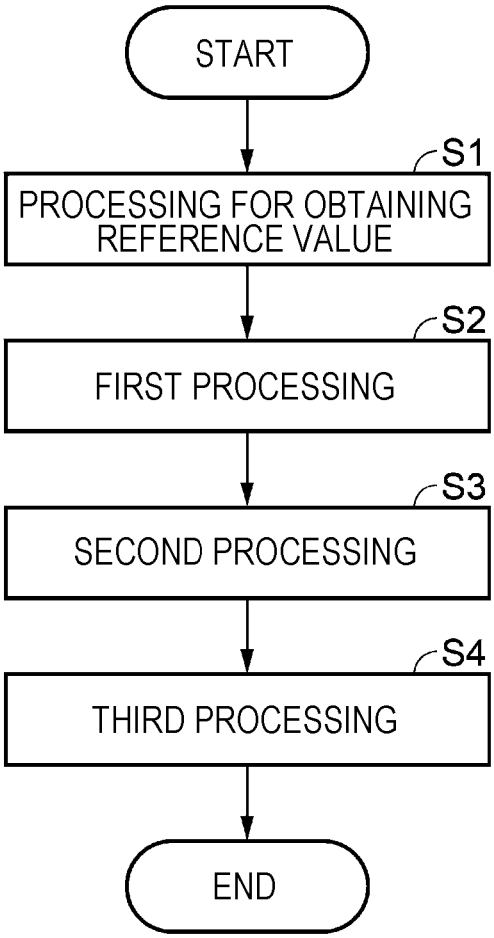
FIG. 3 is a flowchart which illustrates a printing method.

FIG. 3 is a flowchart which illustrates a printing method. FIGS. 4 to 11 are diagrams which illustrate a relative position among the printing unit 5, the mark detecting unit, and the recording medium S. In addition, FIGS. 4 to 11 are plan views in which the recording medium S transported along the transport path Pc is planarized, and positions of the printing unit 5 and the mark detecting unit 80 are denoted by a two dot-dashed line. In addition, a section for printing the image IM is denoted by a dashed line in the recording medium S. The printing method when restarting printing of the printing apparatus 1 will be described with reference to FIGS. 3 to 11.

Step S1 is processing of obtaining a reference value. The reference value is an output value output from the drum encoder E30 when the first mark #1MK corresponding to a position at which printing is restarted is located at a predetermined position with respect to the detecting region 85 of the mark detecting unit 80.

Figure 4:
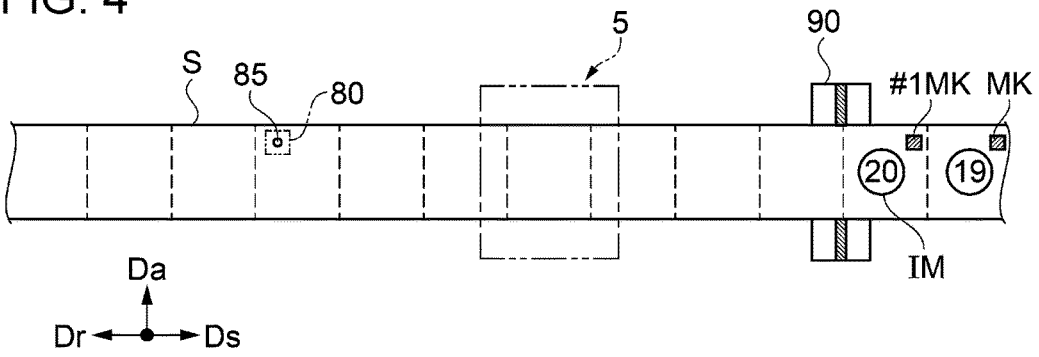
FIG. 4 is a diagram which illustrates a relative position among a printing unit, a mark detecting unit, and a recording medium.

FIG. 4 illustrates a position of the recording medium S when printing of the printing apparatus 1 is stopped. The printer control unit 200 transports the recording medium S to a predetermined stop position in the first direction (forward direction Ds), and stops printing, after printing a twentieth image IM. The predetermined position is set to a cutting position of a cutting table 90 for cutting an end portion on the sending side (upstream side) of the final (twentieth) image IM, for example. In addition, a plurality of marks MK which are paired up with each image IM are printed in parallel in the forward direction Ds in the recording medium S.

Figure 5:
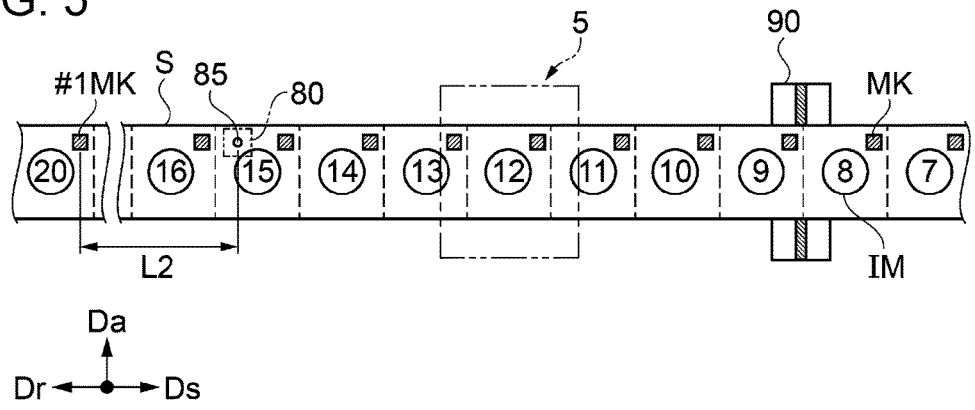
FIG. 5 is a diagram which illustrates a relative position among the printing unit, the mark detecting unit, and the recording medium.

The printer control unit 200 transports the recording medium S in the second direction (backward direction Dr) based on an output value of the drum encoder E30, and positions the first mark #1MK which is printed along with the twentieth image IM on the downstream side of the detecting region 85 of the mark detecting unit 80 in the second direction by a second distance (fourth processing). As illustrated in FIG. 5, the second distance L2 between the first mark #1MK and the detecting region 85 at this time is set to a second stable transport distance or more which is necessary for converging a deviation amount of the recording medium S in the third direction (axial direction Da) into a predetermined deviation amount (second deviation amount) by performing a correction using the steering unit 7 when the recording medium S is transported in the forward direction Ds. In other words, the second stable transport distance is a distance in which deviation of the first mark #1MK in the axial direction Da which is located on the most upstream side is corrected so as to fall within the second deviation amount due to transporting in the forward direction Ds. The second deviation amount is, for example, ±0.7 mm, and is ±0.5 mm, more preferably.

Subsequently, the printer control unit 200 positions the first mark #1MK in the detecting region 85 by transporting the recording medium S (fifth processing).

Figure 6:
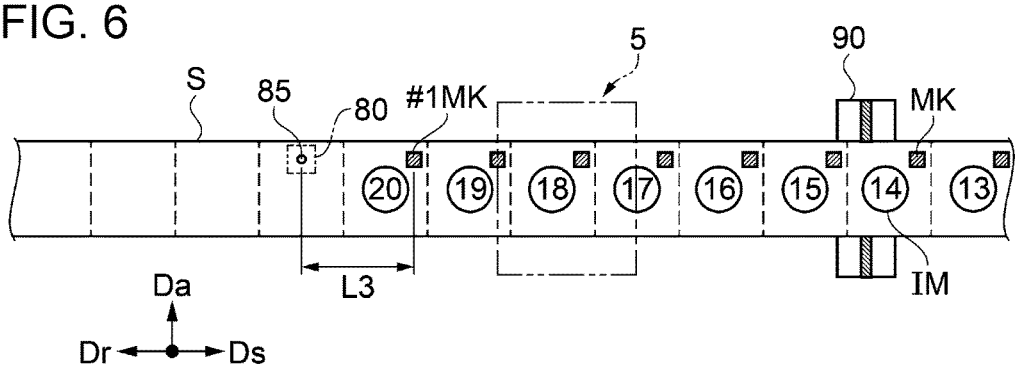
FIG. 6 is a diagram which illustrates a relative position among the printing unit, the mark detecting unit, and the recording medium.

In detail, in transporting of the recording medium S in the forward direction Ds in FIG. 6, the printer control unit 200 stably transports the recording medium S in the forward direction Ds by a distance of the second stable transport distance or more (second distance L2+third distance L3), and positions the first mark #1MK at the second predetermined position which is the downstream side of the mark detecting unit 80 in the first direction by the third distance L3 (distance between the first mark #1MK and detecting region 85 illustrated in figure) (seventh processing). A transport error occurs in transporting of the recording medium S based on the drum encoder E30 due to sliding, or the like, between each unit of the transport unit 6 and the recording medium S. Accordingly, the second distance L2+third distance L3 is set to a distance in which it is possible to make the first mark #1MK reach the downstream side of the detecting region 85, reliably, after adding a transport error between a movement amount calculated from the output value of the drum encoder E30 and an actual movement amount of the recording medium S. In addition, the third distance L3 is set to a distance in which it is possible to detect the first mark #1MK in the mark detecting unit 80 even when the recording medium S is transported in the backward direction Dr in which a steering correction does not work, that is, within a distance in which it is possible to reliably position the first mark #1MK in the detecting region 85 in the axial direction Da, when the first mark #1MK transports the recording medium S located at the second predetermined position in the backward direction Dr by the third distance L3.

The printer control unit 200 receives a signal output from the mark detecting unit 80 in transporting of the recording medium S in the forward direction Ds in FIG. 6, sets minimum light intensity (voltage) thereof to light intensity reflected from the mark MK, and sets light intensity (maximum light intensity) received when transporting is stopped to light intensity reflected on the recording medium S. In addition, an intermediate value between the maximum light intensity and the minimum light intensity is stored in the storage unit 210 as a threshold value when detecting the mark MK. The deviation of the first mark #1MK in the axial direction Da which occurs in transporting in the backward direction Dr from the state in FIG. 4 to the state in FIG. 5 is corrected by the steering unit by performing stable transporting in the forward direction Ds of the second stable transport distance or more from the state in FIG. 5 to the state in FIG. 6. In this manner, it is possible to catch at least the first mark #1MK in the detecting region 85. In addition, setting of the threshold value may be omitted when restarting the second printing and thereafter.

Figure 7:
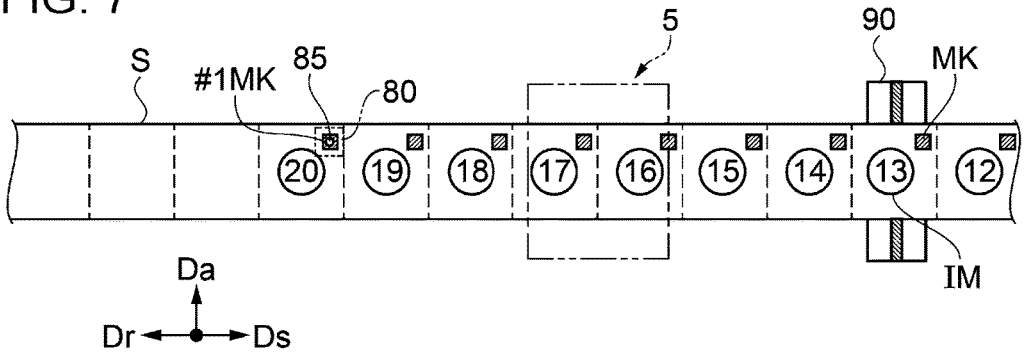
FIG. 7 is a diagram which illustrates a relative position among the printing unit, the mark detecting unit, and the recording medium.

The printer control unit 200 slowly transports the recording medium S in the backward direction Dr, and positions the first mark located at the second predetermined position illustrated in FIG. 6 to the detecting region 85 (eighth processing). In this manner, the first mark #1MK is detected in the mark detecting unit 80. Since the recording medium S is subjected to a stable transport of the second stable transport distance or more, before the detection, it is possible to improve a detection accuracy of the first mark #1MK for obtaining the reference value. In addition, since the first mark #1MK is positioned on the downstream side of the mark detecting unit 80 once, and the recording medium S is transported in the backward direction Dr from there, the firstly detected mark MK reliably becomes the first mark #1MK. In addition, the printer control unit 200 controls each unit of the transport unit 6 and the movement mechanism of the mark detecting unit 80, as illustrated in FIG. 7, a center of the detecting region 85 and a center of the first mark #1MK are approximately matched.

Figure 8:
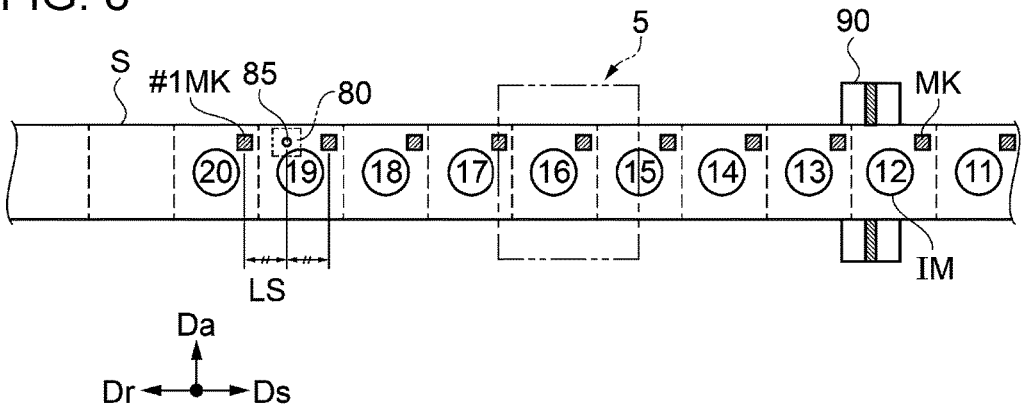
FIG. 8 is a diagram which illustrates a relative position among the printing unit, the mark detecting unit, and the recording medium.

Subsequently, the printer control unit 200 positions the first mark #1MK at the first predetermined position by transporting the recording medium S, as illustrated in FIG. 8. In detail, the printer control unit 200 transports the recording medium S in the backward direction Dr by a distance LS corresponding to a half of a distance between marks MK along the forward direction Ds, and when the first mark #1MK is positioned on the upstream side from the detecting region 85 by the distance LS, the position is set to the predetermined position of the first mark #1MK (first predetermined position) with respect to the detecting region 85. In addition, the printer control unit 200 stores an output value output from the drum encoder E30 when the first mark #1MK reaches the first predetermined position in the storage unit 210 as the reference value, in order to detect arriving at the first predetermined position of the first mark #1MK (sixth processing).

Figure 9:
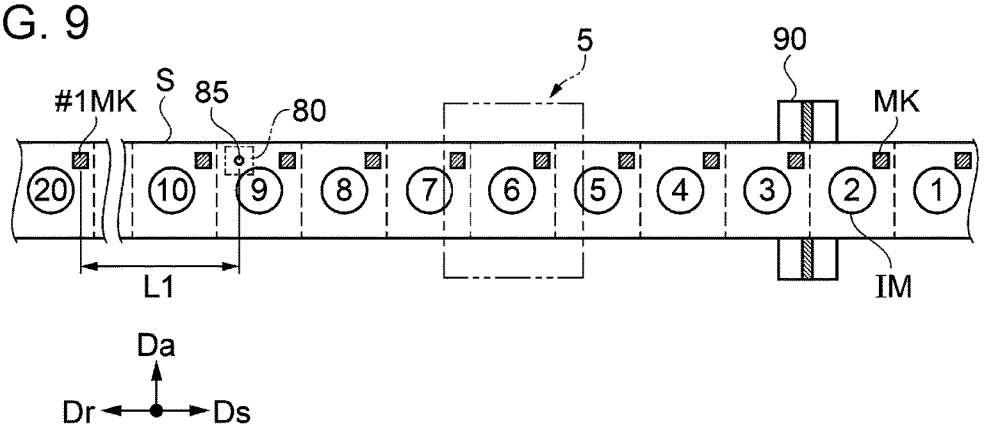
FIG. 9 is a diagram which illustrates a relative position among the printing unit, the mark detecting unit, and the recording medium.

Step S2 is a first processing in which the first mark #1MK is positioned on the upstream side of the detecting region 85 in the first direction (forward direction Ds). As illustrated in FIG. 9, the printer control unit 200 transports the recording medium S in the backward direction Dr by the first distance L1 based on the output value of the drum encoder E30. The first distance L1 is set to the first stable transport distance or more, which is necessary for converging a deviation amount of the recording medium S in the axial direction Da into the predetermined deviation amount (first deviation amount) using a correction by the steering unit 7, until the recording medium S is transported in the forward direction Ds, and reaches the first predetermined position in which the first mark #1MK is located on the upstream side of the detecting region 85 by the distance LS, in the second processing which will be described later. In other words, the first stable transport distance is a distance in which a deviation of the first mark #1MK in the axial direction Da which is located on the most upstream side is corrected so as to fall within the first deviation amount due to transporting in the forward direction Ds. The first deviation amount is, for example, ±0.2 mm, and is ±0.15 mm, more preferably.

In addition, it is necessary for the first deviation amount to fall in a range which is necessary when maintain a printing position accuracy in the axial direction Da, when performing printing; however, in the second deviation amount, since a deviation amount in the axial direction Da in the processing of obtaining the reference value may fall in a deviation amount in which the mark detecting unit 80 can detect the first mark #1MK, it is possible to set the second deviation amount to be larger than the first deviation amount. When the second deviation amount is set to be larger than that first deviation amount, it is possible to set the second stable transport distance to be shorter than the first stable transport distance.

When it is possible to set the second stable transport distance to be short, it is possible to make a transport distance of the recording medium S short in the processing of obtaining the reference value, and reduce a time necessary in processing for obtaining the reference value. Therefore, according to the embodiment, the second stable transport distance is set to be shorter than the first stable transport distance.

Figure 10:
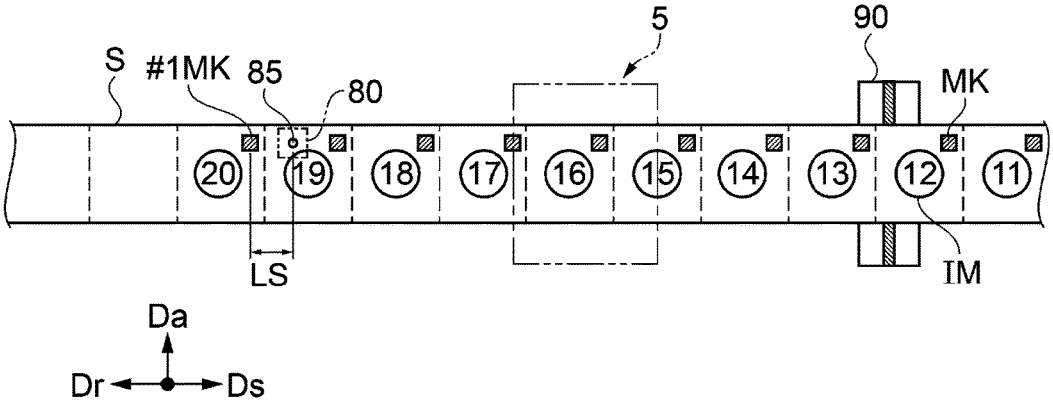
FIG. 10 is a diagram which illustrates a relative position among the printing unit, the mark detecting unit, and the recording medium.

Step S3 is a second processing in which arriving at the predetermined position of the first mark #1MK is detected. The printer control unit 200 sets a detecting operation of the mark detecting unit 80 to OFF. In addition, transporting of the recording medium S in the forward direction Ds is started from the state in FIG. 9, and arriving at the first predetermined position which is upstream side from the detecting region 85 by the distance LS, of the first mark #1MK is obtained based on a comparison between the output value of the drum encoder E30 and the reference value stored in the storage unit 210. Since the printing method has processing of obtaining the reference value corresponding to the output value output from the drum encoder E30 when the first mark #1MK is located at the first predetermined position, it is possible to obtain the fact that the first mark #1MK arrived at the first predetermined position with good accuracy. FIG. 10 illustrates a state in which the first mark #1MK arrived at the first predetermined position. In step S3, transporting of the recording medium S in the forward direction Ds may be started without setting the detecting operation of the mark detecting unit 80 to OFF. In this case, a detecting signal of MK which is detected in the mark detecting unit 80 may be neglected until arriving at the first predetermined position which is upstream side from the detecting region 85 by the distance LS, of the first mark #1MK is detected.

Figure 11:
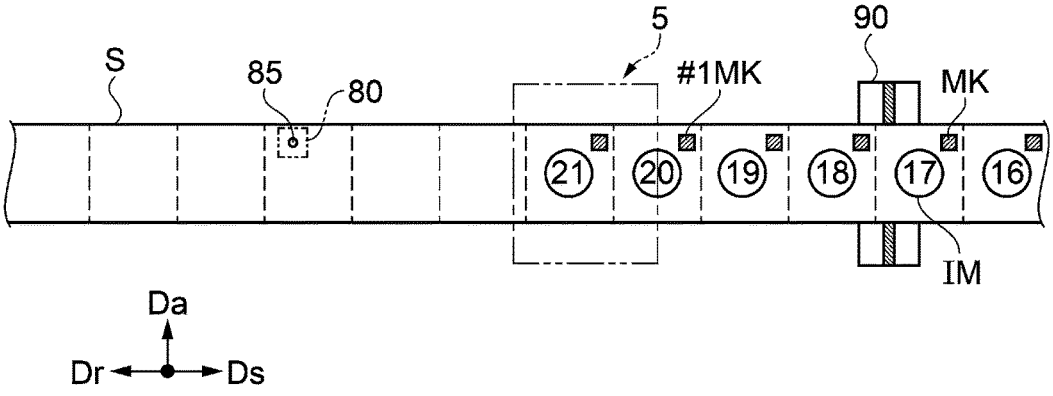
FIG. 11 is a diagram which illustrates a relative position among the printing unit, the mark detecting unit, and the recording medium.

Step S4 is a third processing in which printing of an image by the printing unit 5 is restarted. The printer control unit 200 starts detecting of the mark MK by setting a detecting operation of the mark detecting unit 80 to ON, when arriving at the first predetermined position of the first mark #1MK is recognized, and detects the first mark #1MK which moves from the first predetermined position to the detecting region 85 in the mark detecting unit 80. In addition, the printer control unit starts printing of the image IM using the printing unit 5 based on the timing in which the first mark #1MK is detected. In this manner, as illustrated in FIG. 11, images of the twenty-first image IM and thereafter are printed in predetermined sections, after the twentieth image IM.

Transporting of the recording medium S to the first predetermined position is performed based on the output value of the drum encoder E30. When the recording medium S is transported based on the drum encoder E30, a transport error occurs due to sliding, or the like, which occurs between the transport unit 6 and the recording medium S; however, since printing is started based on the timing in which the mark detecting unit 80 detects the first mark #1MK thereafter, it is possible to settle a printing position between an interruption and a restart of printing with good accuracy.

A deviation of the first mark #1MK (recording medium S) in the axial direction Da which occurs due to transporting in the backward direction Dr from the state in FIG. 8 to the state in FIG. 9, in the first processing in step S2, is corrected by the steering unit 7, by performing stable transporting in the forward direction Ds which is the first stable transport distance or more, from the state in FIG. 9 to the state in FIG. 10, in the second processing in step S3. In this manner, it is possible to reliably catch the first mark #1MK in the detecting region 85 of the mark detecting unit 80, even in a printing apparatus 1 which is not provided with an advanced movement mechanism which moves a position of the mark detecting unit 80 following meandering of the recording medium S which occurs when the recording medium S is transported in the backward direction Dr.

In addition, since the first stable transport distance is longer than the second stable transport distance, it is possible to set the first deviation amount to be smaller than the second deviation amount, and perform printing of an image using the printing unit 5, which is followed thereafter, with good accuracy.

When detecting the first mark #1MK in the mark detecting unit 80, transporting of the recording medium S in the forward direction Ds is temporarily stopped, a recording head which is retreated from a position facing the recording medium S is moved to the position facing the recording medium S, and thereafter, printing may be started after restarting transporting of the recording medium S in the forward direction Ds. In this case, since it is necessary for a transport speed of the recording medium S to reach a predetermined constant speed transport state at a time of starting printing, it is necessary for the recording medium S to be transported in the forward direction Ds by a distance which is necessary when the recording medium reaches the predetermined constant speed transport state, in order to start printing. Accordingly, in this case, it is necessary to set the transport distance L1 of the recording medium S in the backward direction Dr in step S2 to a distance or more which is obtained by adding a constant speed reaching distance to the first stable transport distance. In this manner, even when transporting of the recording medium S in the forward direction Ds is temporarily stopped when the first mark #1MK is detected in the mark detecting unit 80, it is possible to restart printing without transporting the recording medium S in the backward direction Dr thereafter.

The invention is not limited to the above described embodiment, and various modifications can be added to the above described embodiment without departing from the scope of the invention. In the above described embodiment, a case in which the invention is applied to the printing apparatus 1 in which the recording medium S is supported by the cylindrical rotating drum 30 has been exemplified; however, the configuration of supporting the recording medium S is not limited to this. For example, it may be a printing apparatus with a configuration of planarly supporting the recording medium S. The invention can be applied to the entire printing apparatus which performs printing in which the recording medium S is transported by the roll-to-roll method.

The number, a disposal, ejecting colors, or the like, of recording heads 51 and 52 can be appropriately changed. Also the number, a disposal, intensity of UV light, or the like, of the UV irradiators 61 to 63 can be appropriately changed. In addition, transporting type of the recording medium S can be appropriately changed.

According to the embodiment, the invention is applied to the printing apparatus 1 provided with the recording heads 51 and 52 which eject UV ink. However, the invention may be applied to a printing apparatus provided with a print head which ejects water based ink such as resin ink, for example, in addition to UV ink. Alternatively, the invention may be applied to a printing apparatus which performs printing using a material other than ink such as toner.

As described above, according to the printing method in the embodiment, it is possible to obtain the following effects.

The printing method includes the first processing in which the recording medium S is transported in the backward direction Dr by the first distance L1 based on the output value of the drum encoder E30, the second processing in which the recording medium S is transported in the forward direction Ds, and arriving at the first predetermined position of the first mark #1MK is detected based on a comparison of the output value of the drum encoder E30 and the reference value as the output value output from the drum encoder E30, when the first mark #1MK corresponding to a position at which printing of an image is restated is located at the first predetermined position with respect to the detecting region 85 of the mark detecting unit 80, and the third processing in which printing of an image is started based on a timing in which the first mark #1MK which moves from the first predetermined position to a detecting region is detected by the mark detecting unit 80. The first distance L1 is the first stable transport distance or more which is necessary when converging a deviation amount of the recording medium S in the axial direction Da into the predetermined first deviation amount using a correction by the steering unit 7.

Transporting of the recording medium S to the predetermined position in the forward direction Ds in the second processing is performed based on the output value of the drum encoder E30. When the recording medium S is transported based on the drum encoder E30, a transport error occurs due to sliding, or the like, which occurs between the transport unit 6 and the recording medium S; however, since a start of printing is performed based on the timing in which the mark detecting unit 80 detects the first mark #1MK in the third processing, it is possible to settle a printing position between an interruption and a restart of printing with good accuracy.

In addition, since the first distance in which the recording medium is transported in the backward direction Dr in the first processing is the first stable transport distance or more, the deviation of the first mark #1MK in the axial direction Da which occurs when being transported in the backward direction Dr can be corrected so as to fall within the predetermined first deviation amount by the steering unit at a time of transporting in the forward direction Ds by the second processing. In this manner, it is possible to catch the first mark #1MK in the detecting region 85 of the mark detecting unit 80, even in a printing apparatus which is not provided with the advanced movement mechanism which moves a position of the mark detecting unit 80 following meandering of the recording medium S.

In addition, since the first stable transport distance is larger than a constant speed reaching distance, the recording medium S is transported at a predetermined constant speed when the mark detecting unit 80 detects the first mark #1MK. In this manner, it is possible to perform a continuous operation from detecting of the first mark #1MK to printing of an image.

Accordingly, it is possible to provide a printing method in which a printing position accuracy between an interruption and a restart of printing can be easily improved, without accompanying a rise in cost of the printing apparatus 1.

The printing method includes processing of obtaining the output value output from the drum encoder E30 when the first mark #1MK is located at the first predetermined position, as the reference value, ahead of the first processing. In this manner, since it is possible to reliably obtain the timing in which the first mark #1MK reaches the first predetermined position as the reference value, an accuracy of the printing start position when restarting printing can be improved.

In the printing method, a stable transport of the second stable transport distance or more is performed in the processing of obtaining the reference value. In order to obtain the reference value, it is necessary to reliably detect the first mark #1MK which is provided in the recording medium using the mark detecting unit 80. The deviation of the recording medium (first mark #1MK) in the third direction which occurs when moving the recording medium in the second direction, in order to detect the first mark #1MK, is corrected by the steering unit, using the stable transport in the first direction. In this manner, it is possible to improve a detecting accuracy of the first mark #1MK for obtaining the reference value.

Since the second stable transport distance is shorter than the first stable transport distance, it is possible to shorten a time necessary in processing for obtaining the reference value.

This application claims priority under 35 U.S.C. § 119 to Japanese Patent Application No. 2017-054068, filed Mar. 21, 2017. The entire disclosure of Japanese Patent Application No. 2017-054068 is hereby incorporated herein by reference.

What is claimed is:

1. A printing method of a printing apparatus which includes a transport unit which transports a recording medium in a first direction or a second direction opposite to the first direction;

a transport position output unit which outputs a signal which is used when obtaining a transport position of the recording medium using the transport unit;

a printing unit which prints an image on the recording medium;

a mark detecting unit which detects a mark overlapped with a detecting region, among a plurality of the marks which are provided in the recording medium in parallel to the first direction;

a steering unit which corrects a movement of the recording medium in a third direction which intersects the first direction, when transporting the recording medium in the first direction; and a storage unit which stores an output value output from the transport position output unit when a first mark, among the plurality of marks, corresponding to a position at which printing of the image is started, is located at a first predetermined position with respect to the detecting region as a reference value, the method comprising:

first processing in which the recording medium is transported by a first distance in the second direction based on an output value of the transport position output unit, and the first mark is positioned on a downstream side of the detecting region in the second direction;

second processing in which a transport of the recording medium in the first direction is started after the first processing, and arriving at the first predetermined position of the first mark is detected based on a comparison of the output value of the transport position output unit and the reference value; and third processing in which printing of the image using the printing unit is started based on a timing in which the first mark which moves from the first predetermined position to the detecting region is detected by the mark detecting unit, after the second processing, wherein the first distance is a first stable transport distance or more which is necessary when converging a deviation amount of the recording medium in the third direction within a predetermined first deviation amount by a correction using the steering unit until the first mark reaches the detecting region in the second processing.

2. The printing method according to claim 1, comprising:

including processing of obtaining the reference value before the first processing.

3. The printing method according to claim 2, wherein the processing of obtaining the reference value includes fourth processing in which the recording medium is transported in the second direction based on the output value of the transport position output unit, and the first mark is positioned on a downstream side of the detecting region in the second direction by a second distance;

fifth processing in which the first mark is positioned in the detecting region by transporting the recording medium, after the fourth processing; and sixth processing in which the first mark is positioned at the first predetermined position by transporting the recording medium after the fifth processing, and the output value output from the transport position output unit is stored in the storage unit as the reference value, when the first mark reaches the first predetermined position.

4. The printing method according to claim 3, wherein the fifth processing includes seventh processing in which the recording medium is transported in the first direction based on the output value from the transport position output unit, and the first mark is positioned at a second predetermined position which is the downstream side of the detecting region in the first direction by a third distance; and eighth processing in which the recording medium is transported in the second direction based on the output value of the transport position output unit, and the first mark located at the second predetermined position is positioned in the detecting region.

5. The printing method according to claim 4, wherein the second distance is a second stable transport distance or more which is necessary when converging a deviation amount of the recording medium in the third direction into a predetermined second deviation amount, by a correction using the steering unit, until the first mark reaches the detecting region in the seventh processing.

6. The printing method according to claim 5, wherein the first deviation amount is smaller than the second deviation amount, and the second stable transport distance is shorter than the first stable transport distance.

* * * * *